United States Patent [19]

Ninomiya et al.

[11] Patent Number: 5,052,717

[45] Date of Patent: Oct. 1, 1991

[54] BOOKBINDING CLOTH

[75] Inventors: Toshikazu Ninomiya, Kawagoe; Hiroyuki Saito, Tsukuba, both of Japan

[73] Assignees: Dynic Corporation; Dai-Ichi Seiki Kogyo Co., Ltd., both of Japan

[21] Appl. No.: 551,424

[22] Filed: Jul. 11, 1990

[30] Foreign Application Priority Data

Sep. 14, 1989 [JP] Japan ..... 1-107158[U]

[51] Int. Cl.[5] ..... B42D 3/00

[52] U.S. Cl. ..... 281/21.1; 281/29; 281/35; 412/901

[58] Field of Search ..... 281/29, 21.1, 35; 412/4, 901; 283/105

[56] References Cited

U.S. PATENT DOCUMENTS

| | | | |
|---|---|---|---|
| 3,973,787 | 8/1976 | Staata et al. | 281/21.1 |
| 4,284,227 | 8/1981 | Corey | 281/29 |
| 4,371,194 | 2/1983 | Wang et al. | 281/21.1 |
| 4,441,950 | 4/1984 | Lolli | 281/29 |
| 4,471,976 | 9/1984 | Giulie | 281/35 |
| 4,527,814 | 7/1985 | Carter et al. | 281/35 |
| 4,575,122 | 3/1986 | Nava | 281/29 |
| 4,662,865 | 5/1987 | Chorlton et al. | 283/105 |
| 4,793,758 | 12/1988 | Hanson et al. | 412/4 |
| 4,800,110 | 1/1989 | DuCorday | 281/21.1 |
| 4,893,979 | 1/1990 | Alpers | 281/29 |

FOREIGN PATENT DOCUMENTS

| | | |
|---|---|---|
| 56-15021 | 4/1981 | Japan . |
| 60-179296 | 9/1985 | Japan . |
| 61-4675 | 2/1986 | Japan . |

*Primary Examiner*—Frank T. Yost
*Assistant Examiner*—Hwei-Siu Payer
*Attorney, Agent, or Firm*—Harness, Dickey & Pierce

[57] ABSTRACT

A resilient adhesive resin tab adapted to permanently secure paper sheets thereto by edge-binding in a hot melt condition is, at one extreme side peripheral area thereof, bonded or heat-sealed to a width-adjustable backbone of a bookbinding cloth. The adhesive tab may be split, before use, along a selective one of a plurality of equally spaced, lengthwise extending slit rows, to adjust the width in conformity with a thickness of the paper sheets to be edge-bound. One of side extensions formed integrally with the backbone is larger than the other which improves applicability of this bookbinding cloth to bookbinding into a variable thick booklet by folding back the extended portion of the larger side extension in dependence upon the adjusted width of the backbone. The folded end is bonded to the larger side extension by adhesive.

5 Claims, 4 Drawing Sheets

BOOKBINDING CLOTH

BACKGROUND OF THE INVENTION

1. Field of the Invention

This invention relates to a bookbinding cloth provided with a resilient adhesive layer through which a plurality of paper sheets are bound together at aligned one edges thereof.

2. Description of the Prior Art

A typical bookbinding system has been disclosed in U.S. Pat. No. 3,973,787 issued to Staats et al. A foldable book cover or bookbinding cloth is provided, at a backbone thereof, with a normally non-adhesive but thermally activatable adhesive layer. A plurality of paper sheets or the like sheet material are placed, in a gathered, edge-aligned condition, on the adhesive layer which has not yet become adhesive. Heat is then applied to the adhesive so that the aligned edge portions of the paper sheets may be secured to the backbone of the bookbinding cloth through the hot-melted, activated adhesive, which is then cooled to for solidification.

An example of the bookbinding cloth prepared in accordance with the above-described prior art bookbinding technique is diagrammatically illustrated in FIG. 9. The bookbinding cloth 1 in this example includes a backbone 2 of a predetermined width (Wb) and a pair of side extensions 3*a* and 3*b* formed integral with the backbone 2. To the backbone 2 is secured a resilient hot-melt layer 4 of thermally activatable adhesive resin material, which extends over the entire width Wb of the backbone 2 and provides a flat surface for bonding together aligned edges of a plurality of paper sheets 5 of a predetermined thickness (Wp) which should correspond to the width (Wb) of the adhesive layer 4, by applying heat to the backbone 2 to melt the adhesive material in the layer 4 followed by cooling. The side extensions 3*a* and 3*b* have a size substantially identical to or somewhat larger than the paper sheets 5 to thereby serve as front and back covers of a booklet to be produced. The adhesive layer 4 will have a sufficient thickness for assuring permanent bonding and a considerable degree of hardness in a solidified condition, which means that the adhesive layer 4 could not easily be folded in the middle of the predetermined width thereof. To meet various requirements for manufacturing booklets of different thickness (Wp), it will therefore be necessary to prepare a number of book covers which have similar construction but provide different widths (Wb) of backbones and adhesive layer attached thereto.

Another prior art bookbinding cloth has been proposed, in which a single adhesive layer in the above-described prior art is replaced by a plurality of lengthwise extending adhesive layers 4', 4' . . . 4' which are spaced apart and secured in a parallel fashion to the backbone of the bookbinding cloth 1, as can be seen in FIG. 10. Between two adjacent adhesive layers there is provided a lengthwise extending groove which may act as a crease or fold allowing the backbone to be easily folded therealong. It is understood that this prior art bookbinding technique has an advantage that a single kind of bookbinding cloth may be employed for producing booklets of different thickness, by folding the backbone along a selective one of the grooves formed between the ridge-like adhesive layers. However, when the paper sheets are placed above the backbone of this bookbinding cloth, some of them would enter the groove and others would rest on the ridge of the adhesive layer, which inevitably impairs the edge-alignment of the paper sheets in the booklet thus produced.

Japanese Utility-Model Publication No. (Sho) 56-15021 discloses a bookbinding element comprising a sheet made of thermally activatable adhesive material. The adhesive sheet has a plurality of spaced rows of slits or concaved grooves extending in a lengthwise direction. The slit row is discontinued by unslitted parts but the adhesive sheet may be splitted along a desired one of the slit rows to conform the width of the bookbinding element to a given thickness of a booklet to be produced by bookbinding. The adhesive sheet, which has been split to have a desired width, may be attached to a backbone of a book cover through a permanent adhesive layer formed on a backside of the adhesive sheet. The permanent adhesive layer is normally covered with a resin-impregnated paper, which should be peeled off just before bonding of the adhesive sheet to the backbone. This element can be widely used for bookbinding of variable thick booklets. This bookbinding element has a three-layer construction comprising the thermally activatable adhesive sheet, the permanent adhesive layer and the peel-off paper, so that the sheet splitting operation should be made with scissors, cutters or other cutting instruments.

SUMMARY OF THE INVENTION

An object of the present invention is to provide a novel bookbinding system readily incorporated in a small-scale office and home operation, which is capable of eliminating many of the disadvantages which would be found in the prior art systems.

Another object of the present invention is to provide a bookbinding cloth for producing booklets of different thickness, without a substantial increase of manufacturing cost and labor.

Still another object of the present invention is to provide a bookbinding cloth including a thermally activatable adhesive layer for providing a bookbinding effect, which can easily be splitted by hand to thereby conform the width thereof to a predetermined width of a booklet to be produced by bookbinding.

According to an aspect of the present invention there is provided a bookbinding cloth for use in bookbinding of plural sheet materials into a booklet comprising a backbone provided with a plurality of spaced, lengthwise extending first folding lines along which the backbone is easy to be folded; a pair of side extensions extending integrally from opposite sides of the backbone; an adhesive sheet of a thermally activatable adhesive resin material secured at one extreme side peripheral area thereof to a corresponding side of an inner surface of the backbone, the adhesive resin material being melted by heat application to effect edge-binding of the plural sheet materials to the backbone between the side extensions; and a plurality of spaced, lengthwise extending cutting lines provided in the adhesive sheet in position in exact correspondence to the first folding lines formed in the backbone respectively, each of the cutting lines comprising a plurality of aligned slits with small gaps therebetween, along which the adhesive sheet is easy to be splitted. The first folding lines in the backbone and the cutting lines in the adhesive sheet being selectively utilized to adjust the widths thereof in conformity to a thickness of the plural sheet materials to be edge-bound to the backbone.

BRIEF DESCRIPTION OF THE DRAWING

Further objects and advantages of the invention will be understood from the following description when read in conjunction with the accompanying drawing in which.

DETAILED DESCRIPTION OF THE EMBODIMENTS

Figure 1:
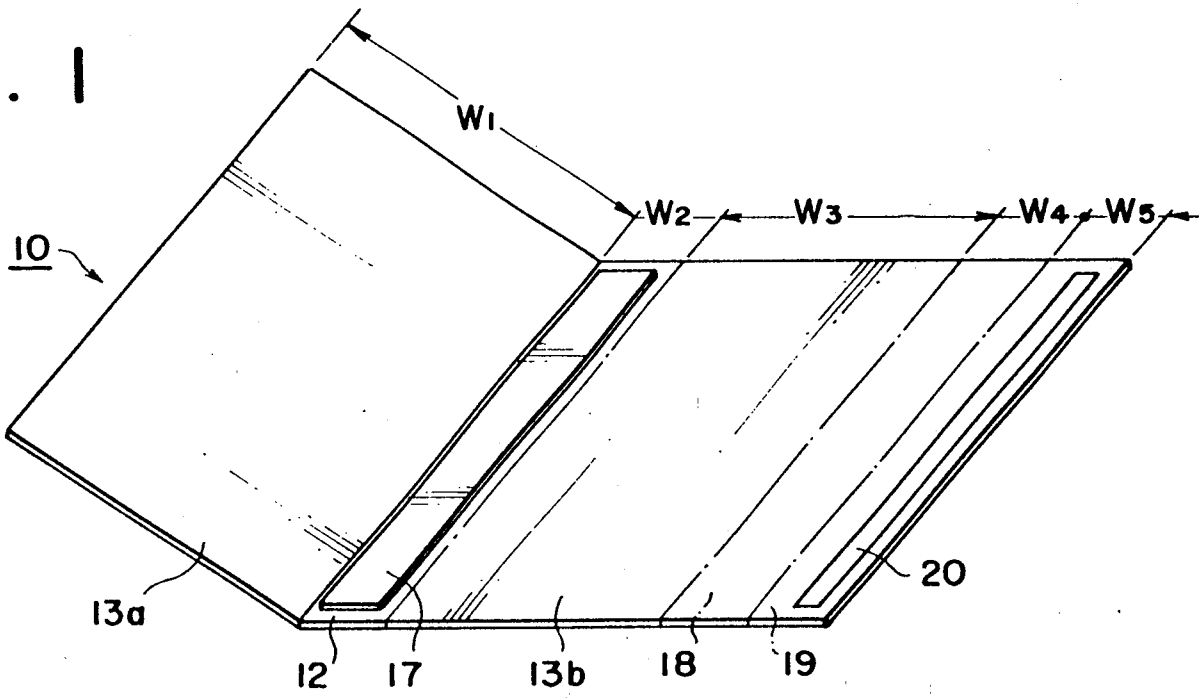
FIG. 1 is a diagrammatic perspective view of a bookbinding cloth embodying the invention.
Figure 2:
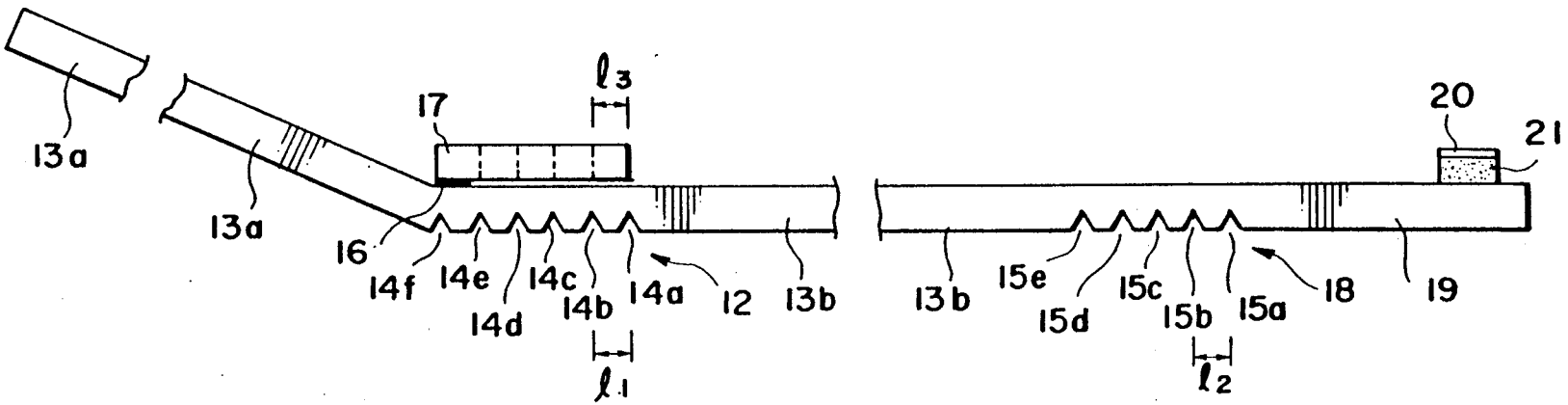
FIG. 2 is an enlarged end-elevational view of the bookbinding cloth.

A bookbinding cloth 10 embodying the present invention is diagrammatically illustrated in FIG. 1 and FIG. 2, which includes a backbone 12 and a pair of side extensions 13*a* and 3*b* formed integrally with the backbone 12 and extending from opposite side peripheries thereof, as known in the prior art. The backbone 12 has a predetermined width (W2) corresponding to a maximum thickness of a booklet to be produced with this bookbinding cloth 10. One of the side extensions 13*a* has a size substantially identical to or somewhat larger than that of paper sheets to be bookbound so that it may serve as a front cover sheet of a booklet to be produced. Meanwhile, the second side extension 13*b* further extends to provide a foldable area 18 so that they cooperate with each other to serve as a back cover sheet of the booklet. The width (W4) of the foldable area 18 will be determined in correspondence with the width (W2) of the backbone 12 as will be understood hereinalater. The width (W3) of the second side extension 13*b* will then be determined by contracting the width (W4) of the foldable area 18 thus determined from the width (W1) of the front cover extension 13*a*. The foldable area 18 further extends to provide a flap 19 having a given width (W5) which is not limited by nature but preferably a little greater than the width (W4) of the foldable area 18. The first side extension 13*a*, the backbone 12, the second side extension 13*b*, the foldable area 18 and the flap 19 are all formed integrally by sheet material such as a pasteboard, a resin impregnated paper and a synthetic resin sheet. A lengthwise extending adhesive layer 21, normally covered by a peel-off tape 20, is provided on a leading end portion of the flap 19.

The backside of the backbone 12 is provided with a plurality of equally spaced, lengthwise extending notches or grooves 14*a* to 14*f* which may be formed by known embossing technique. These notches will allow the bookbinding cloth 10 or the backbone 12 to be easily folded therealong. Prior to the bookbinding operation, the bookbinding cloth 10 will be folded along the leftmost notches 14*f* uprightly with respect to the backbone 12, whereas one of the remaining notches 14*a* to 14*e* is selected as a fold along which the booklet or backbone is bent uprightly to provide the back cover sheet, in dependence upon the thickness of the booklet to be produced. In the illustrated embodiment six notches are provided so that a distance (l1) between the adjacent notches will be one fifths of the width (W2) of the backbone 12.

Similar notches are also provided on the backside of the foldable area 18 in the second side extension 13*b*. In the illustrated embodiment, the foldable area 18 includes five notches 15*a* to 15*e*, inclusive of the extreme end notches 15*a* and 15*e* which may be considered as boundary lines for the main part of the second side extension 13*b* and the flaps 19 respectively. A distance (l2) between the adjacent notches will be identical to the distance (l1). The number of notches in the foldable area 18 will be decreased by one from the number of notches in the backbone 12, so that in this example five notches 15*a* to 15*e* are provided in the foldable area 18. This also means that the width (W4) of the foldable area 18 is four-times that of the distance (l2), in other words, four fifths of the width (W2) of the backbone 12. In general, the width (W2) of the backbone 12 and the width (W4) of the foldable area 18 are related with each other as shown in the following relation:

$$W4 = W2 \cdot (n-1)/n$$

where (n) represents the number of notches formed in the backbone 12, provided that the distance (l1) and (l2) are the same.

A hot-melt sheet or tab 17 made of a thermally activatable adhesive resin, for example, an ethyrene-vinyl acetate copolymer to which may be incorporated suitable additives, is bonded by heat-seal, bonding agent or any other suitable means at one peripheral side edge portion 16 thereof to the backbone 12. Thus, the major portion of the sheet 17 is not directly bonded to the backbone 12 and may therefore be finger-manipulated.

Figure 3:
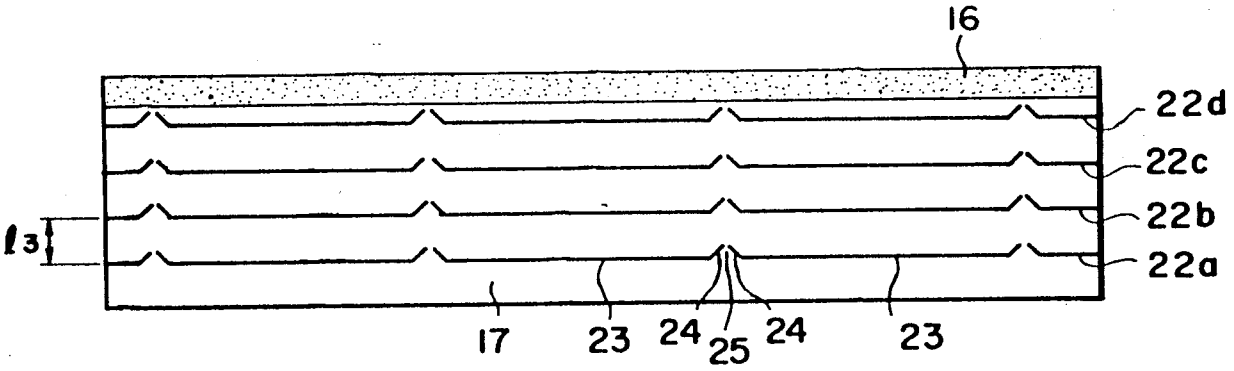
FIG. 3 is an enlarged plan view of a hot-melt sheet employed in the bookbinding cloth.

Referring now specifically to FIG. 3, the adhesive sheet 17 has a plurality of equally spaced, lenthwise extending rows 22*a* to 22*d* of aligned slits 23. More particularly, an end 24 of each slit 23 extends at an oblique angle toward the side 16 to be bonded to the backbone 12, which cooperates with an opposite end 24 of an adjacent slit 23 in the same row to provide a small gap or unslitted portion 25 therebetween. The slit 23 may be replaced by a notch or groove formed deep into the adhesive sheet 17, as far as the adhesive sheet 17 may easily be splitted therealong. A distance or size of the gap 25 will also be determined such that the adhesive sheet 17 may be split along any one of the slit rows 22*a* to 22*d* by pulling a part of the adhesive sheet 17 apart from the bonded peripheral edge portion 16.

The adhesive sheet 17 extends substantially over the entire length and the entire width (W2) of the backbone 12. In an assembled condition wherein the adhesive sheet 17 is attached to the backbone 12 only at the peripheral edge portion 16 thereof, the slit row 22*a* to 22*d* will be positioned in alignment with the notches 14*b* to 14*e* formed in the backbone 12 respectively. A distance (l3) between the adjacent slit rows will be consistent with the distance (l1).

Figure 4:
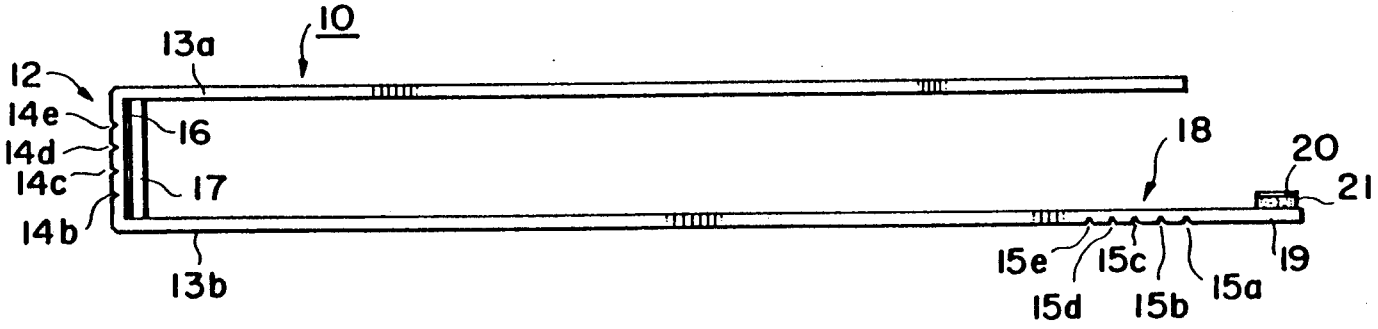
FIG. 4 is an end-elevational view of the bookbinding cloth in a folded condition.
Figure 5:
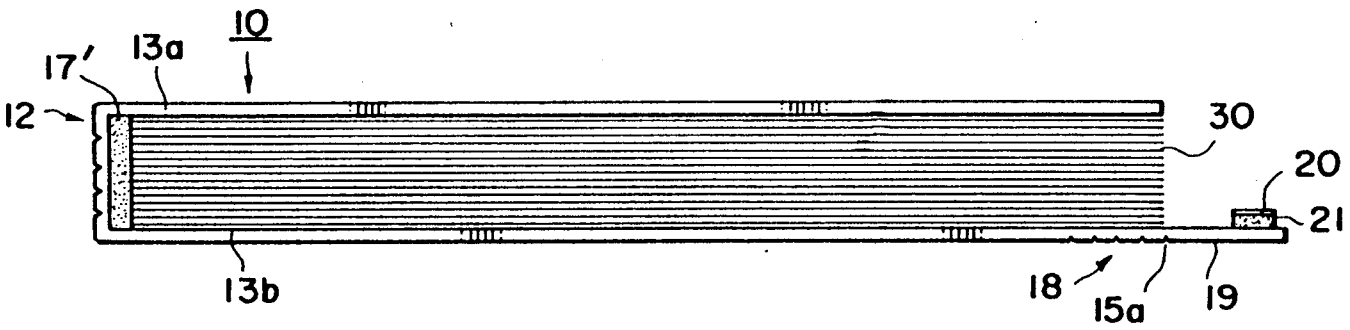
FIG. 5 is an end-elevational view of the bookbinding cloth to which paper sheets are secured by edge-binding.
Figure 6:
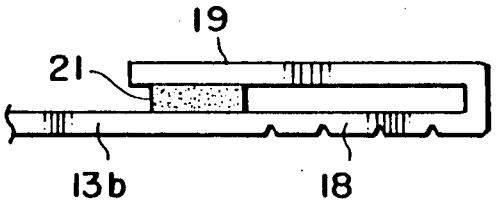
FIG. 6 is an enlarged end-elevational view showing a manner of folding and securing an over-extending portion of a lower side extension.

The bookbinding operation utilizing the bookbinding cloth 10 will be described in detail in reference to FIG. 4 through FIG. 6. More particularly, the backbone 12 of the bookbinding cloth 10 is bent uprightly along a selective one of the grooves 14*a* through 14*e* in correspondence with the thickness of paper sheets 30 to be bonded thereto in a gathered, edge-aligned condition. Also, the adhesive sheet 17 is splitted along a selective one of the slit rows 22*a* through 22*d* to thereby adjust the width thereof to conform with the thickness of the paper sheets 30. Splitting of the adhesive sheet 17 can easily be finger-manipulated due to discontinued arrangement of the slits 23 in each row. The adhesive sheet 17 is at one side 16 thereof firmly connected or heat-sealed to the backbone 12 at this stage, and therefore will not be separated even during the splitting operation. Of course, when the backbone 12 is folded along the extreme groove 14*a* to provide the maximum width (W2) for bookbinding the paper sheets 30, there is no need to split the adhesive sheet 17, as clearly seen in FIG. 4.

After completing such width adjusting operation, the paper sheets 30 gathered in an edge-aligned condition are placed above the the adhesive sheet 17 providing a plane surface. Heat is then applied by a heater (not shown) from the backside of the backbone 12 to hot-melt the adhesive sheet 17 which will become a molten state 17' for providing a bonding effect on the gathered, edge-aligned paper sheets 30. During the heating, the bonding agent 16 which may have been employed for temporary adhesion of the sheet 17 to the backbone 12 will also be hot-melt and dispersed into the molten adhesive 17'. The adhesive 17' is then cooled and solidified so that the paper sheets 30 will be permanently secured to the backbone 12 of the bookbinding cloth 10, with exact alignment of the leading edges thereof, as clearly shown in FIG. 5.

In the illustrated example, the flap 19 still exists extensively and is therefore not in alignment with the first side extension 13*a* and the paper sheets 30 thus bound. What should be done at last in the bookbinding operation is to fold back the flap portion 19 along the boundary line 15*a* and secure the folded end to the second side extension 13*b* through the adhesive layer 21 after the peel-off tape 20 has been removed therefrom as in a manner shown in FIG. 6.

It will be understood that when the backbone 12 should be folded along a different one (14*b*, 14*c*, 14*d* or 14*e*) of the grooves, which requires the adhesive sheet 17 to be splitted along a corresponding one of the slit rows 22*a* to 22*d*, the flap 19, together with a portion of the foldable area 18, will be folded back along a corresponding one of the grooves 15*b* to 15*e*. Thus, the width or size of the back cover of the booklet may be adjusted to the same as that (W1) of the front cover sheet 13, in dependence upon the thickness of the booklet. The bookbinding cloth 10 of this embodiment will therefore be effectively applicable to the bookbinding operation for producing a booklet of a thickness which may be varied within a given range.

In the above-mentioned embodiment, the front and back cover sheets having a size equivalent or corresponding to the paper sheets to be edge-bound are provided by the first side extension 13*a* and the second side extension 13*b* which is turned in along a selective one of the grooves 15*a* to 15*e*, respectively.

Figure 7:
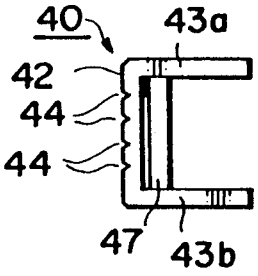
FIG. 7 is an end-elevational view of another embodiment of the present invention.

FIG. 7 shows another embodiment of the invention. A bookbinding cloth 40 prepared in accordance with this embodiment has a backbone 42 to which one side peripheral edge of a hot-melt adhesive sheet 47 is bonded or heat-sealed. The adhesive sheet 47 includes a plurality of slit rows (not shown) along which it may easily be splitted to conform the width thereof with a thickness of a booklet to be produced. The backbone 42 is provided with a plurality of grooves 44, 44 . . . corresponding to the slit row provided in the adhesive sheet 47. These fundamental features will also be found in the afore-mentioned embodiment and therefore need be described in no more detail. A pair of side extensions 43*a* and 43*b* extend integrally from the opposite sides of the backbone 42, but not to the entire extent of paper sheets (not shown) to be bonded to the backbone 42. Thus, the side extensions 43*a* and 43*b* in this embodiment will not serve as front and back cover sheets of the booklet as in the previous embodiment. After the paper sheets have been bonded to the backbone 42 by edge binding through the adhesive 47 substantially in the same manner as in the previous embodiment, the side extensions will be bonded to exposed portions of the sides of the outermost paper sheets adjacent to the edges thus bound. The front and back cover sheets may be constituted by these outermost paper sheets.

Figure 8:
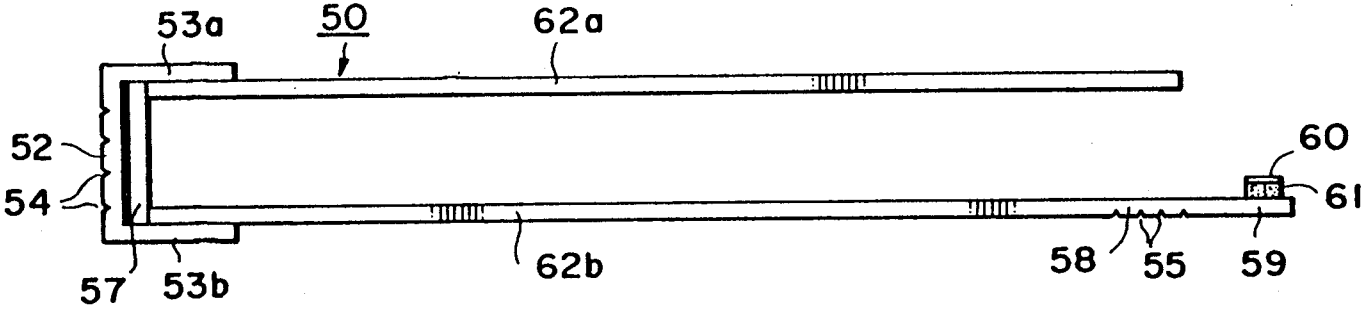
FIG. 8 is an end-elevational view of yet another embodiment of the present invention.
Figure 10:
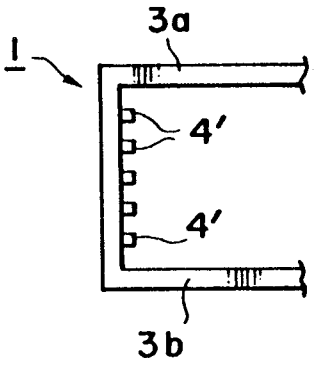
FIG. 10 PRIOR ART
FIG. 10 is an end-elevational view of another prior art bookbinding cloth.
Figure 9:
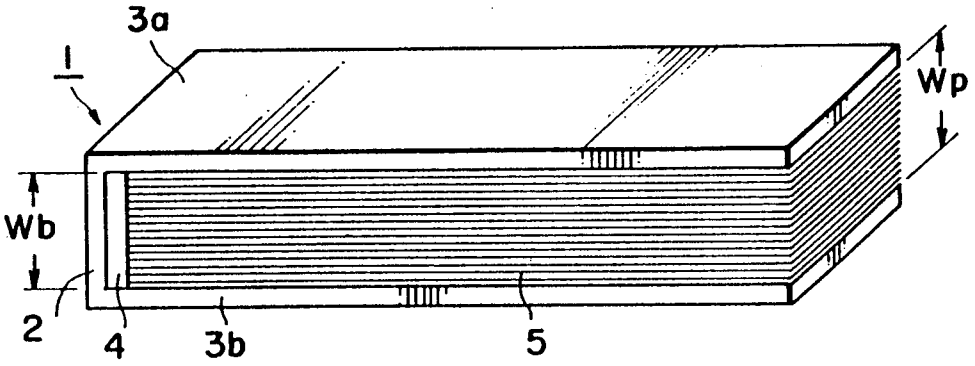
FIG. 9 PRIOR ART
FIG. 9 is a perspective view of a prior art bookbinding cloth.

FIG. 8 shows a bookbinding cloth 50 prepared in accordance with a still further modified embodiment, in which a different type of sheet material 62*a* and 62*b* (which may be more solid or thicker than the paper sheets) edge-bound to a backbone 52 may be separately employed as front and back cover sheets, which will be in advance bonded to small-extensive side extensions 53*a* and 53*b* respectively. The arrangement and construction regarding the backbone 52, the side extensions 53*a* and 53*b*, the grooves 54 and an adhesive sheet 57 will be the same as in the second embodiment shown in FIG. 7. The back cover sheet 62*b* should preferably extend to form integrally therewith a foldable area 58 including plural grooves 55 and a flap 59 provided thereon an adhesive layer 61 normally covered by a peel-off tape 60, as in the first embodiment, for simple width adjustment of the back cover sheet in dependence upon the thickness of the booklet which may be variable.

Although the present invention has been described in conjunction with specific embodiments thereof, it is to be understood that many variations and modifications may be made without departing from spirit and scope of the invention as defined in the appended claims.

What is claimed is:

1. A bookbinding cloth for use in bookbinding of plural sheet materials into a booklet, which comprises:

a backbone provided with a plurality of spaced, lengthwise extending first folding lines along which said backbone is easily folded;

a pair of side extensions extending integrally from opposite sides of said backbone;

an adhesive sheet formed of a thermally activatable adhesive resin material, said sheet having one extreme side peripheral area secured to a corresponding side of an inner surface of said backbone, said adhesive sheet being adapted to be melted by heat application to effect edge-binding of the plural sheet materials to said backbone between said side extensions;

a plurality of spaced, lengthwise extending cutting lines provided in said adhesive sheet in position in substantial correspondence to said first folding lines formed in said backbone respectively, each of said cutting lines comprising a plurality of aligned slits with small gaps therebetween, along which said adhesive sheet is easily split, said slits having oblique ends extending toward said one extreme side peripheral area at which said adhesive sheet is secured to said backbone, said oblique ends cooperating with opposite oblique ends of adjacent slits to define said small gaps between the slits; and said first folding lines in said backbone and said cutting lines in said adhesive sheet being selectively utilized to adjust the widths thereof to conform with the thickness of the plural sheet materials to be edge-bound to said backbone.

2. The bookbinding cloth according to claim 1 wherein said side extensions provide front and back cover sheets of the booklet when assembled.

3. The bookbinding cloth according to claim 2 wherein a first one of said side extensions has a width equivalent to that of the sheet materials to be edge-bound to said backbone to thereby provide a front cover sheet of the booklet, whereas a second side extension extends further beyond said first side extension to be foldable in dependence upon the selected folding line along which said backbone has been folded to thereby provide a back cover sheet of the booklet having a width adjusted to be substantially the same as that of said first side extension.

4. The bookbinding cloth according to claim 3 wherein said second side extension is integrally and extensively provided with a foldable area having a plurality of a second folding lines along which said second side extension is easily folded, and a flap end portion to be secured onto said second side extension by adhesive means.

5. The bookbinding cloth according to claim 4 wherein said adhesive means is provided on said flap end portion, said adhesive means being covered with a removable cover before use.

* * * * *